United States Patent [19]

Tabuchi et al.

[11] Patent Number: 4,975,348

[45] Date of Patent: Dec. 4, 1990

[54] IMAGE HIGHLIGHTING METHOD

[75] Inventors: Kenji Tabuchi; Naoki Toyoshi; Hiroshi Okamoto; Kaoru Takebe; Shoichi Tsuge, all of Osaka, Japan

[73] Assignee: Minolta Camera Kabushiki Kaisha, Osaka, Japan

[21] Appl. No.: 201,194

[22] Filed: Jun. 2, 1988

[30] Foreign Application Priority Data

Jun. 3, 1987 [JP] Japan ..... 62-140496

[51] Int. Cl.[5] ..... G03G 13/01

[52] U.S. Cl. ..... 430/45; 430/54; 430/126; 355/218; 355/245; 355/328

[58] Field of Search ..... 355/7, 4, 32, 77, 14 R, 355/133, 218, 244, 245, 326, 327, 328, 267; 430/100, 45, 54, 42, 126

[56] References Cited

U.S. PATENT DOCUMENTS

| | | | |
|---|---|---|---|
| 3,038,799 | 5/1962 | Metcalfe et al. | 430/100 |
| 3,773,507 | 11/1973 | Sato et al. | 430/100 |
| 3,808,026 | 4/1974 | Sato et al. | 430/42 X |
| 3,936,172 | 2/1976 | McVeigh | 355/133 X |
| 4,579,443 | 4/1986 | Abuyama et al. | 355/4 |
| 4,582,417 | 4/1986 | Yagasaki et al. | 355/7 |
| 4,720,750 | 1/1988 | Watanabe | 355/14 R X |

FOREIGN PATENT DOCUMENTS

| | | |
|---|---|---|
| 950767 | 7/1974 | Canada . |
| 61-256357 | 11/1986 | Japan . |

*Primary Examiner*—A. T. Grimley
*Assistant Examiner*—Robert Beatty
*Attorney, Agent, or Firm*—Burns, Doane, Swecker & Mathis

[57] ABSTRACT

An electrophotographic copying process produces a photocopy having a negative image in order to highlight information in a specified area. An original image is radiated onto a photosensitive medium to form a first image. A solid block is formed in the specified area of the first image. The first image is then transferred to blank paper. The original image is then radiated onto the photosensitive medium again and a portion of the image is erased in order to form a second image. The second image is then transferred to the sheet of paper having the first image. The resulting image formed on the sheet of paper includes a highlighted second image formed in the specified area.

8 Claims, 4 Drawing Sheets

IMAGE HIGHLIGHTING METHOD

BACKGROUND OF THE INVENTION

1. Field of the Invention

The present invention generally relates to an electrophotographic process and, more particularly, to an image forming method utilizing the electrophotographic process.

2. Description of the Prior Art

In the field of printing industry, a technique is largely employed in which a selected portion of a document such as, for example, the title of the document is formed in a negative image while the other portion of the same document is formed in a positive image. The image of the document as a whole so formed by the utilization of this technique is characterized in that the image of the selected portion of the document which is negative is so highlighted as compared with that of the other portion of the same document as to present a fascinating design to viewers enough to attract the attention of the viewers.

However, when it comes to a copying machine today available in the market, the primary function of it is to make a duplication of, or copy, an image of a document on a copying medium as faithfully as possible and, therefore, the conventional copying machine has a problem in that any image forming method in which only a selected portion of the image is subjected to such a reversal development as hereinabove described cannot be embodied in the conventional copying machine.

SUMMARY OF THE INVENTION

Accordingly, the present invention has been devised with a view to substantially eliminating the above discussed problem and has for its essential object to provide a novel image forming method which can be practiced in an electrophotographic copying machine to form a selected portion of the image of the document in a negative image.

To this end, the image forming method herein disclosed in accordance with the present invention is such that, during one cycle of electrophotographic copying operation performed by the copying machine, two successive image forming processes are executed. The first image forming process includes formation of an image of the document on a copying medium, for example, a copying paper, with the use of a first toner and, at the same time, formation of a daubed area on the copying paper in a preselected region corresponding to a selected portion of the document image. The second image forming process includes formation of the selected portion of the document image on the daubed area of the copying paper with the use of a second toner different in color from the first toner.

BRIEF DESCRIPTION OF THE DRAWINGS

This and other objects and features of the present invention will become readily understood from the following description taken in conjunction with a preferred embodiment thereof with reference to the accompanying drawings, in which.

DETAILED DESCRIPTION OF THE EMBODIMENT

Figure 1:
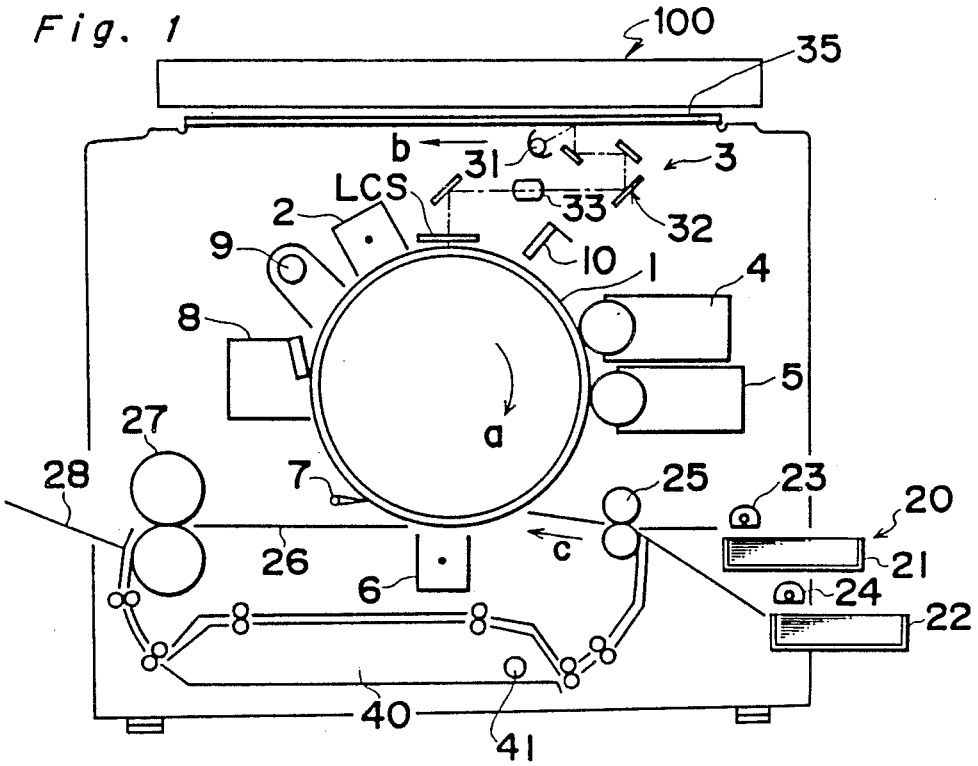
FIG. 1 is a schematic diagram showing an electrophotographic copying machine used to execute an image forming method of the present invention.

With particular reference to FIG. 1, an electrophotographic copying machine used to practice an image forming method of the present invention comprises a machine housing of generally rectangular box-like configuration, within which a photosensitive drum 1 is supported for rotation in one direction, for example, clockwise as shown by the arrow a, about a support shaft that defines the axis of rotation of such drum 1. As is well known to those skilled in the art, during one complete rotation of the photosensitive drum 1, the photosensitive drum 1 moves sequentially past a charging station at which an electrostatic charger 2 is disposed for imparting an electrostatic charge (for example, a negative charge in the illustrated instance) of predetermined potential to the outer peripheral surface of the drum 1 forming a photosensitive surface; an exposure station at which a ribbon of light carrying an image of that original document placed on a document support 35 which is successively scanned by an image exposing device 3 is projected onto the photosensitive surface of the drum 1 through a liquid crystal panel LCS to form an electrostatic latent image on the photosensitive surface of the drum 1 in a pattern complemental to the image of the original document; a developing station at which a developer material is applied to develop the electrostatic latent image into a visible powder image; a transfer station at which a transfer charger 6 is disposed for applying an electric field to a copying paper S, being supplied in a direction shown by the arrow c, so that the powder image can be electrostatically transferred onto a copying paper supplied from a paper supply unit 20 by way of a timing roller pair 25 synchronized with the rotation of the drum 1; and a cleaning station at which a blade-type cleaning unit 8 and an eraser lamp 9 are disposed one after another with respect to the direction of rotation of the drum 1 for removing residue toner and residue electrostatic charge remaining on the photosensitive surface of the drum 1, respectively, in readiness for the next cycle of electrophotographic copying process.

The copying paper having the powder image which has been transferred from the drum 1 at the transfer station is peeled off from the photosensitive surface of the drum 1 by a separating claw 7 and is then conveyed by a delivery conveyor 26 towards a fixing roller pair 27. Then, the copying paper having the image fixed thereon is transported towards a copy receiving tray 28.

The image exposing device 3 referred to above movable in a direction shown by the arrow b for scanning successive incremental portions of the original document placed on the document support 35 comprises an illuminator lamp 31 capable of emitting a ribbon of light used to illuminate successive incremental portions of the original document as the image exposing device 3 moves in the direction b, and an optical system including a plurality of reflecting mirrors, generally identified by 32, and an objective lens assembly 33 for guiding and projecting the ribbon of light, which has been reflected from the original document and therefore carrying the image of the original document, onto the photosensitive surface of the drum 1.

The developing station includes a first developing unit 4 and a second developing unit 5, the first developing unit 4 positioned on the upstream side of the second developing unit 5 with respect to the direction a of rotation of the drum 1. So far illustrated, the first and second developing units 4 and 5 are of a well-known magnetic brush developing type, and the first developing unit 4 accommodates therein a first developer mix containing a white, insulating toner while the second developing unit 5 accommodates therein a second developer mix containing a black, insulating toner. For the purpose of the present invention, the first and second developing units 4 and 5 are selectively brought into operation during first and second image forming processes as will be described later.

For selectively driving the developing units 4 and 5, some methods can be employed. One method is that the first and second developing units, supported for movement in a direction towards and away from the photosensitive surface of the drum 1, are selectively driven towards and away from the photosensitive surface of the drum 1. Another method is that, while magnet rollers disposed inside a developing sleeve are provided for rotation through a predetermined angle, a switching is effected between a developing position, in which the magnetic pole confronts the photosensitive surface of the drum 1, and a non-developing position in which a spacing between magnetic poles confronts the photosensitive surface of the drum 1. A still another method is that the bias voltage applied to the developing sleeve applied during the non-developing position is increased to a value higher than that applied during the developing position. In any event, all of these methods are disclosed in the copending U.S. application Ser. No. 59,850, now U.S. Pat. No. 4,752,802, which is herein incorporated by reference and, therefore, the details thereof will not be reiterated here.

In any event, the developer mix utilizable in any one of the first and second developing units 4 and 5 is a mixture of a mass of insulating toner particles with a mass of magnetic carrier beads, said toner particles and said carrier beads capable of being triboelectrically charged to respective polarities opposite to each other. Specifically, in the illustrated instance, the toner particles can be triboelectrically charged to a polarity (positive) opposite to the polarity of the electrostatic charge developed by the electrostatic charger 2. The specific manner by which the developer mix in any one of the first and second developing units 4 and 5 is transported so as to develop the electrostatic latent image on the photosensitive surface of the drum 1 into the visible powder image is well known in the art and, therefore, the details thereof will not be herein reiterated for the sake of brevity.

Positioned radially outwardly of the photosensitive drum 1 and between the exposure station and the developing station is an inter-image eraser 10 used to remove electric charges by the application of light onto the photosensitive surface of the drum 1. This inter-image eraser 10 comprises a plurality of light emitting diodes housed in a multistage fashion within a holder arranged so as to extend in a direction parallel to the axis of rotation of the photosensitive drum 1. This inter-image eraser 10 can function as an editing unit when a combination of the light emitting diodes to be lit and the timing at which they are to be lit are suitably controlled, and, as shown in FIG. 5 which illustrates an editing map having a grid pattern which corresponds to image forming areas on the outer peripheral surface of the photosensitive drum 1 in a developed form, the inter-image eraser 10 can emit light towards each of blocks divided in a direction conforming to the direction of rotation of the photosensitive drum 1 and also in a direction perpendicular thereto.

The liquid crystal panel LCS disposed at the exposure station in the vicinity of the photosensitive drum 1 is generally rectangular in shape having a predetermined width and extends parallel to the axis of rotation of the drum 1. This liquid crystal panel LCS is comprised of a plurality of liquid crystal elements which are electrically connected to a source of electric power and which are operable to selectively permit and interrupt the passage of the imagewise light therethrough towards the photosensitive surface of the drum 1 during the application and inapplication of an electric field in response to an signal from a control device (not shown). During a normal copying condition, however, the liquid crystal panel is held in a state permitting the passage of the imagewise light therethrough towards the photosensitive surface of the drum 1.

Figure 5:
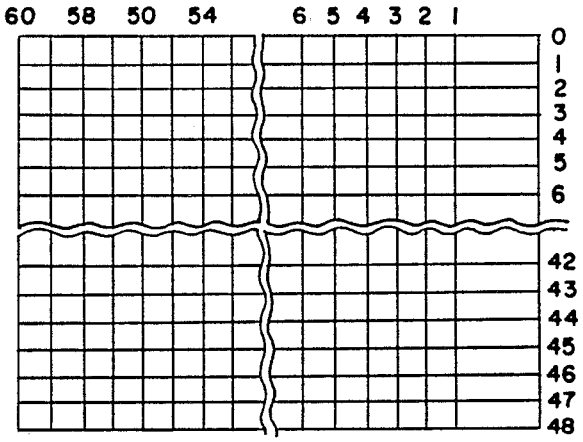
FIG. 5 is a top plane view of an image editing unit.

By arbitrarily controlling the combination and the timing of application of the electric fields, the liquid crystal panel LCS functions as an editing device, and, as shown in FIG. 5 which illustrates the photosensitive drum 1 in a developed form, arrangement has been so that the light can be selectively transmitted and intercepted with respect to each of blocks divided in a direction conforming to the direction of rotation of the photosensitive drum 1 and also in a direction perpendicular thereto.

Mounted on the document support 35 so as to cover the document support 35 is an image editing device generally identified by 100, the structure and the function of which will be described later.

The paper supply unit 20 includes a plurality of, for example, two, paper supply trays accommodating therein respective paper cassettes 21 and 22 having corresponding stacks of copying papers of different size. These trays are adapted to be selectively brought into operation one at a time at the will of an operator of the machine in a manner well known to those skilled in the art. The papers in each of the paper cassettes 21 and 22 can be supplied to the timing roller pair 25 by the action of a corresponding paper feed roller 23 or 24 also well known to those skilled in the art.

Positioned generally beneath the photosensitive drum 1 is a paper recirculating unit 40 for recirculating the copying paper from the transfer station back to the transfer station via the fixing station for the purpose which will become clear from the subsequent description.

Figure 3:
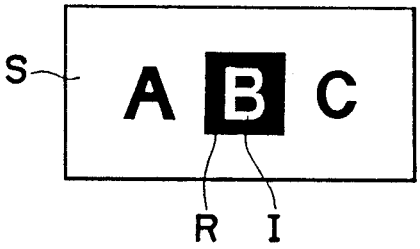
FIG. 3 is a view similar to FIG. 2, showing the copying paper bearing both of the reproduced image of the document which is accomplished by the first image forming process and a reproduction of an image of a selected portion of the document which is accomplished by a second image forming process of the image forming method of the present invention.
Figure 4:
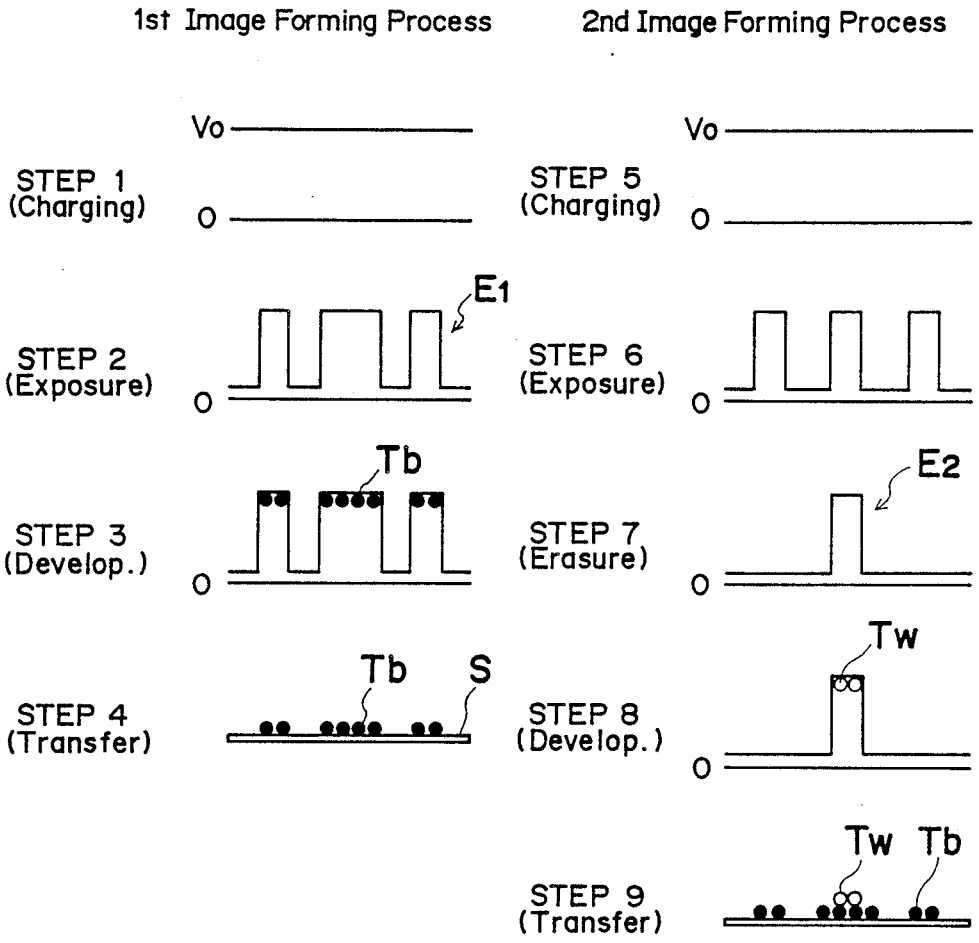
FIG. 4 is a diagram showing image forming process steps according to the present invention.

The function of a reversal copying mode during which a portion of the document to be copied is reproduced in a negative image with the use of the copying machine of the construction hereinabove described will now be described with particular reference to FIGS. 2 to 4.

At the outset, an area R of the document OD in which the negative image is desired to be formed is specified.

Figure 6:
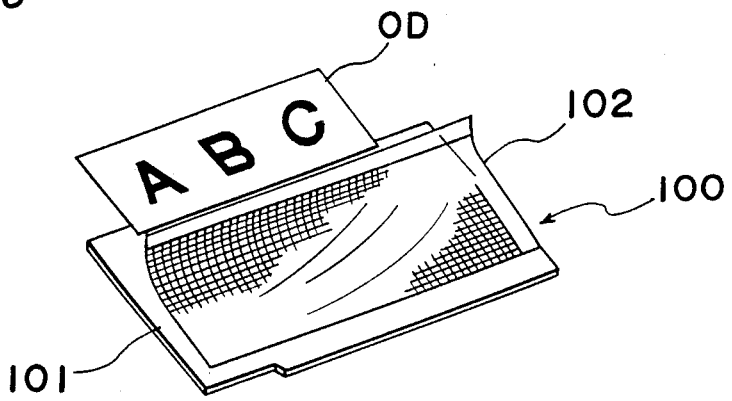
FIG. 6 is a perspective view of the image editing unit.
Figure 7:
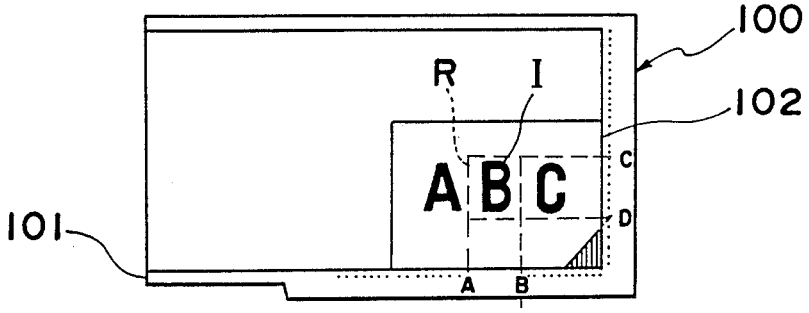
FIG. 7 is a top plane view of an image editing unit showing the manner in which an area is to be specified.
Figure 8:
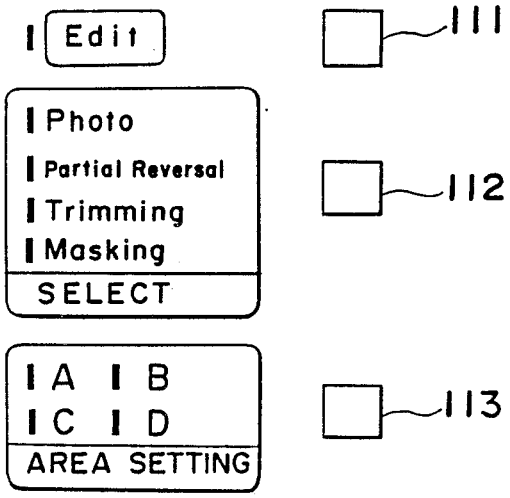
FIG. 8 is a diagram showing various operating buttons provided in the image editing unit.
Figure 9:
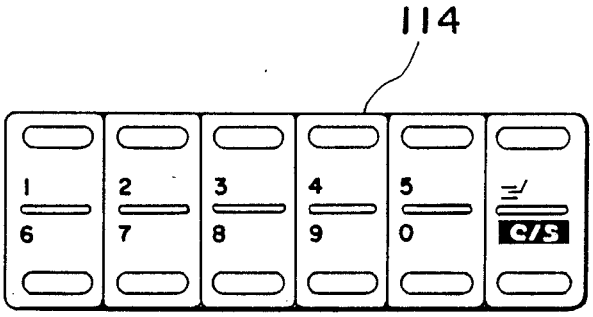
FIG. 9 is a diagram showing tens keys arranged in a operating panel in the copying machine.

In the illustrated embodiment, the area R can be specified by the utilization of the image editing device 100 (FIGS. 6 and 7), mounted atop the copying machine, and some of a number of keys (FIGS. 8 and 9) disposed on an operating panel. As best shown in FIGS. 6 and 7, the image editing device 100 is comprised of a generally rectangular document holder 101, which serves as a document retaining means operable to press the document OD against the document support 35 and which is, therefore, supported for pivotal movement between opened and closed positions, and an image editing map 102. The document holder 101 has scale calibrations formed at at least one of the opposite side edges thereof and also at at least one of the opposite ends thereof. The image editing map 102 is in the form of a generally rectangular transparent sheet having an imprinted, or otherwise embossed, grid pattern of a plurality of blocks, as best shown in FIG. 5, and secured at one side to the corresponding side edge of the document holder 101 for selective opening and closing.

The document OD is sandwiched between the document holder 101 and the transparent image editing map 102 with the image on the document OD oriented upwards, and, then, coordinates A, B, C and D corresponding to four corners of that area R of the document OD desired to be reproduced in a negative image are to be read.

Subsequently, an editing mode selector switch 111 disposed on the operating panel has to be turned on to set the machine in the image editing mode, followed by depression of a selector switch 112 to select a partial reversal mode. Then, a AREA SETTING button 113 is depressed to key in the coordinates A to D by manipulating some of the tens keys 114. Data so inputted, that is, keyed in, can be stored in a control unit (not shown).

After a preparatory procedures has been finished in the manner as hereinabove described, the document OD is placed on the document support 35, and a PRINT switch is to be subsequently depressed to initiate the actual copying operation which will now be described.

When the copying operation is initiated subsequent to the specification of area R of the document OD in which the negative image is desired to be formed, a first image forming process is executed. It is to be noted that, during the execution of this first image forming process, only the second developing unit 5 is utilized and is brought into operation while the first developing unit 4 is held inoperative or retracted away from the photosensitive drum 1.

While the photosensitive drum 1 is rotated in the direction shown by the arrow a, the photosensitive surface of the drum 1 is uniformly charged by the electrostatic charger 2 to the negative polarity. (STEP 1).

Then, as the illuminator lamp 31 of the image exposing unit 3 illuminates the document OD on the document support 35 while moved in the direction shown by the arrow b to scan successive incremental portions of the document OD, rays of light reflected from, and carrying the image of, the document OD are projected on the photosensitive surface of the drum 1 through the reflecting mirrors 32, the objective lens assembly 33 and the liquid crystal panel LCS. It is, however, to be noted that a portion of the imagewise light representative of that portion of the image of the document OD which is encompassed by the specified area R of the document OD is intercepted by the liquid crystal panel LCS and is, therefore, not projected onto the photosensitive surface of the drum 1. In other words, the liquid crystal panel LCS is set, on the basis of the data of area R stored in the control unit, in a state in which some of the liquid crystal elements corresponding to that portion of the imagewise light representative of that area R can be successively held in condition, in which no electric field is applied thereto in synchronism with the scanning of the successive incremental portions of the document OD. While undergoing a scroll at a speed equal to the peripheral speed of rotation of the drum 1, the LCS intercepts that portion of the imagewise light to form on the photosensitive surface of the drum 1 an electrostatic latent image E1 in which a portion of the electrostatic charge other than that associated with the image area and that area R is erased. (STEP 2).

During the continued rotation of the drum 1, the electrostatic latent image is moved past the first developing unit 4, then held inoperative, towards the second developing unit 5. As this electrostatic latent image moves past the second developing unit 5, black toner particles are applied over the electrostatic latent image on the photosensitive surface of the drum 1 to develop a black powder image Tb in a pattern complemental to the pattern of the remaining electrostatic charge on the photosensitive surface of the drum. (STEP 3). It is to be noted that, at this time, since the first developing unit 4 is held inoperative, no white toner particles are applied over the image area of the electrostatic latent image.

Simultaneously with the subsequent arrival of the powder image on the drum 1 at the transfer station, a copying paper S is supplied in a known manner from one of the paper cassettes 21 and 22 towards the transfer station for receiving the black powder image from the drum 1. Synchronization of the arrival of the copying paper S at the transfer station with the arrival of the black powder image on the drum at the transfer station can be accomplished by controlling the timing roller pair 25 in a manner well known to those skilled in the art. Transfer of the black powder image Tb from the drum 1 onto the copying paper S is effected by causing the transfer charger 6 to apply a charge on the copying paper S while the drum 1 and the copying paper S continue their respective movement. (STEP 4).

The copying paper S having the black powder image Tb having been transferred thereto from the drum 1 at the transfer station is subsequently supplied by the conveyor 26 towards the fixing roller pair 27. As this copying paper S passes through the fixing roller pair 27, the black powder image Tb is firmly fixed on the copying paper in a manner known to those skilled in the art. The copying paper S having the black powder image fixed thereon is, as it emerges from the fixing roller pair 27, deflected by a changeover lever (not shown) so as to enter the paper recirculating unit 40 and is then retained temporarily, thereby completing the first image forming process.

Figure 2:
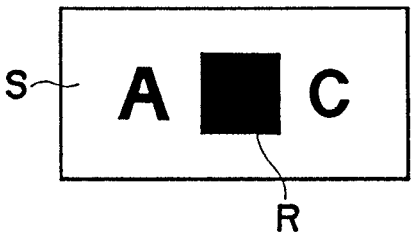
FIG. 2 is a top plan view of a copying paper bearing a reproduction of an image of the document which is accomplished by a first image forming process of the image forming method of the present invention.

The copying paper S so processed through the first image forming process as hereinabove described is in the form having a portion corresponding to that area R which is developed in a black solid area while the remaining portion of the copying paper S is formed with the image of the original OD, as best shown in FIG. 2.

During the further continued rotation of the drum 1, residue toner particles and residue electrostatic charge remaining on the photosensitive surface thereof are successively removed by the cleaning unit 8 and the eraser lamp 9, respectively.

Thereafter, the second image forming process takes place. During the execution of the second image forming process, the first developing unit 4 is brought into operation while the second developing unit 5 utilized during the execution of the first image forming process is held inoperative or retracted away from the photosensitive surface of the drum 1.

While the drum 1 still continues to rotate in the direction shown by the arrow a, the photosensitive surface thereof is again uniformly charged by the electrostatic charger 2, followed by the projection of the imagewise light through the image exposing unit 3 onto the photosensitive surface of the drum 1 in a manner similar to that during the execution of the first image forming process. However, during this second image forming process, the liquid crystal elements of the liquid crystal panel LCS are applied with an electric field and, therefore, the entire image of the document OD is projected onto the photosensitive surface of the drum 1. (STEP 6).

Then, some of the light emitting diodes of the interimage eraser 10 which do not correspond to that specified area R are energized to light in synchronism with an image of that specified area R so that only a portion of the electrostatic charge on the photosensitive surface of the drum 1 which corresponds in position to that specified area R can be allowed to remain, while the other electrostatic charge is erased, to form an electrostatic latent image E2. (STEP 7).

The electrostatic latent image E2 is subsequently brought to the developing station at which white toner particles are applied by the first developing unit 4 onto the photosensitive surface of the drum 1 to develop a white powder image Tw. (STEP 8).

On the other hand, the copying paper S retained in the paper recirculating unit 40 after having been transferred with the powder image Tb during the execution of the first image forming process is supplied by a paper supply roller 41 towards the timing roller pair 25 in synchronism with the rotation of the drum 1 and is then supplied through the timing roller pair 25 towards the transfer station in synchronism with the arrival of the white powder image Tw at the transfer station. Thus, by the effect of the discharge of the transfer charger 6, the white powder image Tw can be transferred onto the area R of the copying paper S so as to "overprint" the black solid area containing the black toner particles Tb. (STEP 9).

The copying paper having the white powder image Tw transferred thereto is conveyed by the conveyor 26 and is passed through the fixing roller pair 27 operable to fix the white powder image on the copying paper S in overlapping relation with the black solid area. Thereafter, the copying paper is ejected onto the copy receiving tray 28.

Thus, an image which is a reversal of the specified area R is formed on the copying paper S which has been processed through the second image forming process in the manner as hereinbefore described. In other words, as best shown in FIG. 3, at the specified area R, an image I is developed in white color with its background developed in black color.

Although the present invention has been described in connection with the preferred embodiment thereof with reference to the accompanying drawings, it is to be noted that various changes and modifications are apparent to those skilled in the art. By way of example, while reference has been made to the use of the black and white toner particles in the second and first developing units, a combination of toner particles of any other different colors may be employed.

Accordingly, such changes and modifications are to be understood as included within the scope of the present invention as defined by the appended claims unless they depart therefrom.

We claim:

1. A method of forming an image by the use of an electrophotographic process, which method comprises:

a first charging step of charging a photosensitive medium;

a first step of radiating an image onto a surface of the charged photosensitive medium except for a specified area of such surface, thereby to form a first electrostatic latent image including a negative image area;

a first developing step of developing the first electrostatic latent image, formed on the material to provide a first powder image;

a first transfer step of transferring the first powder image onto a copying paper;

a second charging step of charging the photosensitive medium again;

a second step of radiating the image and forming a second electrostatic latent image on the specified area of the surface of the charged photosensitive medium;

a second developing step of developing the second electrostatic latent image, formed on the specified area of the photosensitive medium, by the use of a second toner material different in color from the first toner material, thereby to form a second powder image; and a second transfer step of transferring the second powder image onto the negative image area formed on the copying paper to which the first powder image has been transferred.

2. The method as claimed in claim 1, wherein light used to radiate the photosensitive medium is the light reflected from an original document to be copied.

3. The method as claimed in claim 1, wherein the second toner material has a color identical with that of the copying paper.

4. A method as claimed in claim 1, wherein said negative image area is designated by the use of a designating means.

5. A method of forming an image by the use of an electrophotographic process, which method comprises:

a first charging step of charging a photosensitive medium;

a first step of radiating an image onto a surface of the charged photosensitive medium except for a specified area of such surface, thereby to form a first electrostatic latent image;

a first developing step of developing the first electrostatic latent image, formed on the photosensitive medium, by the use of a first toner material to provide a first powder image;

a first transfer step of transferring the first powder image onto a copying paper;

a second charging step of charging the photosensitive medium again;

a second step of radiating the image onto the surface of the charged photosensitive medium;

a step of radiating a light onto the surface of the photosensitive medium except for the specified area of such surface, thereby to form a second electrostatic latent image in the specified area;

a second developing step of developing the second electrostatic latent image, formed on the photosensitive medium, by the use of a second toner material different in color from the first toner material, thereby to form a second powder image; and a second transfer step of transferring the second powder image onto the first powder image on the copying paper so as to overlay the first powder image.

6. A method as claimed in claim 5, wherein light used to radiate the photosensitive medium in the first radiating step is partially interrupted to leave the charges at said specified area.

7. A method as claimed in claim 6, wherein said light is interrupted by a liquid crystal panel having a plurality of liquid crystal elements.

8. A method as claimed in claim 5, wherein the light used to radiate the surface of the photosensitive medium except for the specified area of such surface is radiated by a plurality of light emitting diodes.

* * * * *